United States Patent [19]

Daumit et al.

[11] 4,255,377

[45] Mar. 10, 1981

[54] PROCESS FOR PRODUCING LOW TENSILE FACTOR POLYESTER YARN

[75] Inventors: Gene P. Daumit; Alan Buckley, both of Charlotte; Gerald W. Davis, Salisbury, all of N.C.

[73] Assignee: Fiber Industries, Inc., Charlotte, N.C.

[21] Appl. No.: 799,851

[22] Filed: May 23, 1977

Related U.S. Application Data

[62] Division of Ser. No. 568,078, Apr. 14, 1975, abandoned.

[51] Int. Cl.[3] ..... D01D 5/12

[52] U.S. Cl. ..... 264/176 F; 264/235

[58] Field of Search ..... 264/176 F, 210 B, 235

[56] References Cited

U.S. PATENT DOCUMENTS

| | | | |
|---|---|---|---|
| 3,553,305 | 1/1971 | Au | 264/210 Z |
| 3,946,100 | 3/1976 | Davis et al. | 264/210 Z |
| 4,049,763 | 9/1977 | Mineo et al. | 264/210 Z |

FOREIGN PATENT DOCUMENTS

| | | | |
|---|---|---|---|
| 2117659 | 10/1972 | Fed. Rep. of Germany | 264/210 Z |
| 45-1932 | 1/1970 | Japan | 264/210 Z |
| 51-43424 | 4/1976 | Japan | 264/210 Z |
| 51-60728 | 5/1976 | Japan | 264/210 Z |

*Primary Examiner*—Jay H. Woo

*Attorney, Agent, or Firm*—Herbert M. Adrian, Jr.

[57] ABSTRACT

Yarns of balanced low tensile characteristics, especially low tensile factor ($TE^{\frac{1}{2}}$) are produced in high speed spinning (e.g. greater than 10000 fpm) operations including an annealing stage by process control, particularly inverse spinning temperatures for given yarn. Polyethylene terephthalate yarns of balanced tensile characteristics and tensile factor of as little as 15–17 are prepared directly from a spin draw line at maximum productivity.

3 Claims, No Drawings

PROCESS FOR PRODUCING LOW TENSILE FACTOR POLYESTER YARN

This is a division, of application Ser. No. 568,078, filed Apr. 14, 1975, now abandoned.

INTRODUCTION

This application relates to spindraw processes for the preparation of synthetic organic filamentary structures, and particularly yarns for textile use. More specifically, it involves high speed takeup operations employing fiber forming polymers capable of developing substantial tensile properties through the application of extensional stresses. Particularly, polymers having lower rates of crystallization such as polyethylene terephthalate are subjected to high speed stress-anneal processes under conditions to control property development on a continuous basis adapted to commercial application.

Most specifically, this invention provides a novel polyester yarn characterized by a low tensile factor, as low as 14–22 in the case of the preferred polyethylene terephthalate; and a process for its production in high speed stress-anneal operations.

BACKGROUND OF THE INVENTION

Yarns of low tensile factor adapted particularly for use as fleece yarns have not been prepared heretofore by a straightforward spinning process from ordinary polymer in a manner consistent with commercial production techniques. Rather, it had been necessary to deliberately degrade the intrinsic viscosity of the polymer (see U.S. Pat. No. 3,396,446 issued Aug. 13, 1968) or to disrupt the crystalline structure by the addition of modifying monomer ingredients such as pentaerythritol (see Canadian Pat. No. 901,716 issued May 30, 1972) to achieve yarn structures of such tensile properties: typically tenacity of about 3.0 gpd and an elongation of about 30% ($TE\frac{1}{2}=16$).

It is of course known that by utilization of various spinning techniques in conventional systems, a 'trade-off' as between tensile strength and elongation may be achieved at relatively constant tensile factor. However, even in these systems it is difficult to secure balanced tensile characteristics in the low tensile factor range e.g. 14 to 22, with tenacities of 2.5 to 4.0 gpd, preferably about 3.0 gpd and elongations of 25 to 40%, preferably about 30.

In the course of development, it has been determined that intermediate and high tensile fibers having properties like those prepared in a conventional lagged drawing operation can be produced directly from the spinning step by utilizing high speed takeup techniques. An improvement in such processing is effected by introducing a stress annealing step post-quench. In this approach invented by Messrs. Davis, Jaffe & Besso, the yarn is passed under tension through a heat treatment zone prior to initial windup in a high speed spin-draw sequence. The fibers so produced exhibit significant tensile development at low shrinkage and a novel morphological structure. A further description is contained in copending Appln. Ser. Nos. 400,863–4 of Messrs. Davis et al filed Sept. 26, 1973, assigned to the parent corporation of the present assignee.

GENERAL DESCRIPTION OF THE INVENTION

It has now been discovered that a post-quench stress anneal process can be utilized to successfully spin-draw polymer of low rate of crystallization at high speed to products of balanced low tensile characteristics by selective control of operating parameters.

It was anticipated from conventional teachings that maximization of spin line stress would enhance tensile properties in such systems, and increasing takeup speed is correlatable with increased tensile development at spinning. Increased spin line stress is also known in this art to be conventionally afforded by lowering spin temperature or increasing intrinsic viscosity, which tend toward an increase in melt viscosity and concomitant enhancement of tensile development. Accordingly, were products of low tensile characteristics to be predictably produced under controlled process conditions by reference to conventional spinning, the expected correlation would be to higher spin temperatures or decreased intrinsic viscosity i.e. lower melt viscosities.

Surprisingly, it has now been discovered that balanced low tensile yarns can be produced directly from ordinary polymer in a selected process regime utilizing high speed spin-draw stress anneal spinning. Specifically, balanced and controlled low tensile characteristics are developed in high speed spin-draw operations by utilization of controlled high melt viscosity: ordinarily, with given polymer viscosity and static system parameters by reducing spinning temperature. Such an approach as practised according to this specification is inconsistent with conventional techniques.

Now, yarns can be produced which when composed wholly of ethylene terephthalate units exhibits tensile factors ($TE\frac{1}{2}$) in the range of e.g. 14–22, preferably about 15–17 and retain intrinsic viscosities on the order of 0.6. Employing the precepts of this invention, the spinning temperature is controlled to lie in a somewhat reduced value range e.g. 280° up to about 295° C., preferably at least 285° C. for a 0.55–0.70 e.g. 0.65 intrinsic viscosity polymer. Here the increase in melt viscosity afforded together with the high speed takeup stress anneal treatment generates directly a fiber structure characterized by low tensile factor, yielding all other attributes of a conventionally spun yarn from ordinary polymer, all with perservation of maximum productivity.

While not wishing to be bound by an essentially hypothetical explanation, it is believed that the production of useable low tensile yarn in accordance with this disclosure may be the result of the dynamic interaction of stress anneal processing with actual or incipient melt fracture induced under the high speed spinning conditions imposed upon a high melt viscosity system. Consistently, it has been suggested that stress anneal processing is associated with an effective increase in the number of 'tie' molecules with relaxed amorphous chains between the crystalline regions.

Thus, it is surmised that microfissures developed in the course of low temperature, high melt viscosity spinning are modified and possibly at least partially cured by subsequent stress anneal treatment, providing useable fiber structures of low tensile factor in direct spinning.

The yarns of this invention are produced, as stated above, under conditions to maximize melt viscosity utilizing ordinary undegraded virgin polymer on standard high speed equipment. Most sensibly, the process regime required is achieved under constant operating parameters in other respects by reducing spinning temperature. It will be understood by one skilled in this art that reduction of temperature ultimately generates an unworkable condition. Further, it is appreciated that absolute temperature monitoring is not available in plant equipment without excessive calibration, hence a stepwise reduction of 1–2 degrees may be most readily employed to achieve the desired critical range.

The necessary condition in the stress anneal zone is the maintenance of temperature and residence time at levels such that modification in crystalline morphology is completed in that zone, minimizing the fluctuation in yarn properties which would otherwise result. Thus, the rate characteristic of the polymer for development of tenacity and elongation is taken into account in determining the length of the stress anneal zone and the temperature at which it is operated at a given takeup speed. If this rate is not separately considered, a simple monitoring step will permit the necessary regulation. Under normal conditions with static system parameters in other respects, fluctuation in yarn properties reflecting incomplete modification of crystalline structure is avoided, and tensile properties optimized, at maximum stress anneal zone temperature. Polymer of lower intrinsic viscosity exhibiting a higher rate of crystallization will permit lower temperatures or a reduced length of zone.

In practical terms, the takeup speed is maximized to exceed 10000 fpm, preferably to lie in the range of 12000–15000 fpm or higher, and zone length is fixed to conform to plant requirements ordinarily less than 10 feet. Accordingly, the necessary process control is achieved by interrelating polymer viscosity, spinning temperature, and stress anneal temperature. Thus, in spinning a given polymer a selective spinning temperature is correlated with stress anneal temperature by reference to crystallization and tensile development rates.

SPECIFIC DESCRIPTION OF THE INVENTION

Typically, polyethylene terephthalate having an intrinsic viscosity of 0.60 to 0.70 is spun through a conventional melt spinning pack employing a spinnerette of the usual design adapted to produce a multiplicity of filaments, normally 15 or more, usually of 1–8 denier per filament.

The filaments are expressed directly into a stable quench zone adapted to reduce the material temperature below glass transition or second order transition temperature, suitably by the use of relatively cooler and often ambient air. In high speed takeup operations extensional stresses induced will ordinarily extend into the quench zone and act directly upon filament forming from the bulge at the exit from the spinnerette face. In the ordinary course, the quench zone will be on the order of 2 to 3 feet in length and may employ an air flow in the range of 40 to 100 cfm. Cross flow quench systems are particularly preferred for the provision of superior yarn uniformity.

The yarn is sequentially passed to a stress anneal zone providing an elevated temperature post quench, ordinarily in the form of a heater tube as of the type represented by a standard nylon steam conditioning tube.

The rather high speed at which the thread line is passed through these treatment zones requires consideration of residence times relative to the rates at which the morphological development in that phase can occur. It is found that the stress anneal zone should in the ordinary system be removed at least 3 feet and up to 6 feet from the spinnerette face and therefore need not be contiguous with the termination of the quench zone. The conditioning tube itself may be of any length although plant requirements will ordinarily dictate a length of less than 10 feet, often as little as 1 up to 9 feet. Usually the structure is that of a jacketed chamber heated with steam or Dowtherm vapor to in excess of 100° C. up to 260° C. or more. One suitable device constitutes a 5/16 inch diameter cylindrical tube. Temperatures and residence time then are selected from a tube of given length such that as discussed above the region of property fluctuation reflecting crystalline change is exceeded. The yarn is passed from the tube to a takeup and may, of course, in its traverse through this zone be treated in other respects as by application of finish, introduction of compaction or interlacing by the action of air jets and the like, if desired.

While the cylindrical tube can very in length and internal diameter, it is clear that such sizes merely represent means for inducing sufficient heat into the yarn at the high speed throughput to raise the yarn temperature above the second order transition temperature without the yarn contacting the interior walls of the tube. At the noted required high speed throughput, strong air currents are generated by the frictional drag of the yarn in air such that these air currents tend to follow the yarn through the tube, thereby insulating the yarn from the heated walls of the tube. These insulating effects can be mitigated by reducing the interior tube diameter to the minimum as well as by tube length and operating temperatures. Modifications of tube structure to reduce such air currents are also known such that the particular tube size becomes a matter of convenience based on the requirements of heat input into the yarn. In general, interior tube diameters ranging from about ¼ inch to 4.0 inch, depending on the noted factors and total yarn denier, have been found to be satisfactory at tube lengths of 1 to 9 feet. Shorter tubes with more efficient heat transfer capabilities and countercurrent heat flows are also envisioned.

The most significant operating parameter for the control of tensile properties is spinning temperature, as the most practical means of effecting the desired melt viscosity.

A reduction in spinning temperature from the norm for a polymer of given viscosity grade is employed to secure yarn of low tensile properties directly. A reduction in temperature of 3 to 8 degrees is ordinarily adequate for this purpose. Accordingly, values of 285–295 are preferably employed with polyethylene terephthalate of intrinsic viscosity 0.55–0.70, preferably 0.60–0.65, particularly at higher wind-up speeds. Excessively cool operations are detectable by poor stringup and runnability and will therefore be readily avoided.

At these spinning temperatures and a 2–5 filament denier the conditioning tube is maintained at a temperature of at least 200° C. preferably 220° C. to 260° C. for a conditioning tube of 1–4 feet in length and operations in the range of 10–15 thousand feet per minute.

Fibrous structures having low tensile properties may therefore be recovered directly i.e. without further processing such as drawing, and employed in the form of continuous filament, or staple; yarn, tow or roving; or processed into non-woven structures having utility in e.g. interlining.

A particularly valuable property of the yarns produced by this invention is that the tensile characteristics are developed in a balanced manner for a given tensile factor. Thus, it has always been possible to produce yarn of low tensile factor at insignificant tenacity but the product is of virtually no use. In contradistinction, the yarns of this invention exhibit interrelated tensile characteristics balanced in their development, where each element contributes significantly to the calculation of tensile factor. For tensile factors of 14 to 22, tenacity may range from 2.5 to 4.0 g/denier and elongation may be 25 to 40%.

The polymers employed are prepared in a manner usual for fiber forming operations, and typically exhibit intrinsic viscosities in the region 0.50 to 1.0 or more. The preferred polymers are the linear polyesters, particularly the terephthalate type most preferably containing at least 85 mol percent of recurring ethylene terephthalate units. These polyesters may be modified for dye receptivity by the inclusion of dye openers such as adipic acid or dye sites such as 5-sulfoisophalate units. Polymer blends may of course be employed, and certain mixtures employing a minor amount of polymer of higher rate of crystallinity such as polybutylene terephthalate or a crystalline nucleation agent is seen to offer advantages.

Although the invention has been described hereinabove with particular reference to polymers like polyethylene terephthalate having lower rates of crystallization, it is understood that an appreciation of the principles underlying these disclosures will permit application to other polymers.

EXAMPLE I

To illustrate the invention, 70/36 yarn was spun from polyethylene terephthalate polymer through a 72 hole pack with 0.009×0.12" orifices to a cross flow quench zone 3 ft. in length and thence to a 2 meter nylon steam conditioner tube at 80 psig. positioned 6 ft. from the spinnerette under the conditions and with the results indicated in the following table.

| RUN | POLYMER I.V. | QUENCH RATE, CFM | SPEED | (DOWBOX) TEMP. | TE½ | TEN. | ELONG. | ΔN | B.W.S. |
|---|---|---|---|---|---|---|---|---|---|
| 1 | .675 | 40 | 10000 | 292° C. | 14.5 | 2.64 | 31.16 | 109.11 | 6.50 |
| 2 | .675 | 40 | 10000 | 292° C. | 17.1 | 3.01 | 32.86 | 112.09 | 6.50 |
| 3 | .675 | 40 | 10000 | 295° C. | 19.8 | 3.19 | 37.57 | 108.03 | 6.00 |
| 4 | .675 | 40 | 10000 | 295° C. | 18.3 | 3.05 | 35.50 | 112.01 | 4.56 |
| 5 | .675 | 40 | 10000 | 300° C. | 26 | 3.80 | 49.30 | 128.28 | 6.25 |
| 6 | .675 | 40 | 10000 | 300° C. | 27.6 | 3.95 | 49.48 | 114.68 | 6.25 |
| 7 | .675 | 40 | 10000 | 300° C. | 25.5 | 3.67 | 46.50 | 113.32 | 6.00 |
| 8 | .675 | 40 | 10000 | 300° C. | 26.9 | 3.88 | 47.54 | 117.84 | 6.00 |
| 9 | .675 | 40 | 10500 | 292° C. | 17.9 | 3.22 | 32.80 | 115.51 | 6.50 |
| 10 | .675 | 40 | 10500 | 292° C. | 16.8 | 3.01 | 32.14 | 117.05 | 6.25 |
| 11 | .675 | 40 | 10500 | 295° C. | 19.1 | 3.24 | 34.62 | 111.38 | 6.50 |
| 12 | .675 | 40 | 10500 | 295° C. | 19.0 | 3.17 | 35.50 | 107.98 | 6.25 |
| 13 | .675 | 50 | 10500 | 295° C. | 17.2 | 2.96 | 33.72 | 107.27 | 6.25 |
| 14 | .675 | 40 | 10500 | 300° C. | 25.1 | 3.75 | 45.32 | 118.30 | 6.50 |
| 15 | .675 | 40 | 10500 | 300° C. | 26.3 | 3.98 | 44.32 | 115.94 | 6.75 |
| 16 | .675 | 50 | 10500 | 300° C. | 23.4 | 3.72 | 39.88 | 113.01 | 6.75 |
| 17 | .675 | 50 | 10500 | 300° C. | 25.8 | 3.91 | 43.48 | 115.44 | 6.50 |
| 18 | .675 | 30 | 10500 | 300° C. | 25.0 | 3.85 | 42.22 | 110.61 | 6.75 |
| 19 | .675 | 30 | 10500 | 300° C. | 27.1 | 3.99 | 46.32 | 113.79 | 6.50 |
| 20 | .675 | 40 | 11000 | 292° C. | 17.4 | 3.02 | 33.55 | 111.96 | 6.25 |
| 21 | .675 | 40 | 11000 | 292° C. | 16.8 | 2.97 | 32.12 | 110.81 | 6.00 |
| 22 | .675 | 40 | 11000 | 295° C. | 21.2 | 3.43 | 38.66 | 103.30 | 6.25 |
| 23 | .675 | 40 | 11000 | 295° C. | 19.7 | 3.17 | 38.88 | 108.75 | 6.25 |
| 24 | .675 | 40 | 11000 | 300° C. | 27.3 | 3.90 | 49.68 | 96.67 | 6.50 |
| 25 | .675 | 40 | 11000 | 300° C. | 27.0 | 3.87 | 48.36 | 116.06 | 6.25 |
| 26 | .675 | 40 | 11500 | 295° C. | 22.1 | 3.39 | 44.52 | 105.89 | 6.50 |
| 27 | .675 | 40 | 11500 | 295° C. | 22.0 | 3.56 | 39.26 | 114.85 | 6.75 |
| 28 | .675 | 40 | 11500 | 300° C. | 25.5 | 3.86 | 43.22 | 121.84 | 6.50 |
| 29 | .675 | 40 | 11500 | 300° C. | 27.0 | 3.87 | 48.36 | 116.06 | 6.25 |
| 30 | .61 | 40 | 12000 | 295° C. | 21.8 | 3.71 | 34.76 | 133.79 | 6.50 |
| 31 | .61 | 40 | 12000 | 295° C. | 23.9 | 3.83 | 39.36 | 133.79 | 6.50 |
| 32 | .675 | 40 | 12000 | 300° C. | 25.7 | 3.84 | 44.94 | 109.26 | 6.75 |
| 33 | .61 | 40 | 12000 | 300° C. | 24.1 | 3.88 | 39.02 | 126.78 | 6.75 |
| 34 | .61 | 40 | 12000 | 300° C. | 25.6 | 3.98 | 40.60 | 133.79 | 6.50 |

EXAMPLE II

Low tensile 70/36 yarn was produced from 0.675 I.V. polyethylene terephthalate under controlled conditions at a threadline (spin-draw) speed of 13000 fpm, wherein the spun and quenched yarn was passed through a 2 ft. zone of controlled elevated temperature (185° C. at the bottom and 105° C. at the top) removed 6 ft. from the spinnerette.

As polymer temperature (pack inlet, Dowbox reading) was lowered from 291° to 287° C. the yarn of this invention was produced:

| Polymer Temp.; °C. | Ten. | Elong. | TE | BWS |
|---|---|---|---|---|
| 291 | 4.14 | 41.8 | 26.82 | 5.2 |
| 290 | 4.02 | 42.1 | 26.04 | 5.7 |
| 287 | 3.55 | 30.5 | 19.77 | 5.0 |

The abrupt property change as a function of polymer temperature is evident, suggesting the criticality in the process regime for provision of the novel fiber structures of the present invention.

What is claimed is:

1. A process for the production of filamentary yarn structures characterized by controlled and balanced tensile characteristics and low tensile factor comprising spinning polyethylene terephthalate having an intrinsic viscosity of at least 0.55 through a multifilament pack maintained at a temperature in the range of 280° to 295° C. to produce filaments of 1 to 8 dpf;

quenching the filaments to below the glass transition temperature;

passing said filaments through an annealing zone 1 to 9 ft. in length commencing 3 to 6 ft. from the spinning pack said annealing zone being maintained at a temperature of at least 200° C. up to the melting temperature;

simultaneously forwarding or taking up said filaments at a windup speed of 10000–15000 fpm;

and recovering yarn having a tensile factor of between 14 and 22, at a tenacity of between about 2.5 and 4.0 g/den. and an elongation of between about 25 and about 40 percent.

2. A process for the production of low tensile factor yarn at high productivity according to claim 1 comprising providing a fiber forming polyethylene terephthalate polymer;

melt spinning said polymer at an elevated temperature;

quenching the fiber thus formed;

passing the quenched fiber through said annealing zone maintained at a temperature in excess of 150° C. up to about 300° C. for a period sufficient to affect crystalline structure;

and thereafter taking up said fiber at a linear speed of at least 10000 fpm, wherein the spinning temperature is selected to lie in a region 3°–8° C. less than that affording maximum tensile factor for such polymer.

3. The process of claim 1 wherein crossflow quench air is supplied at ambient temperature and a rate of 40 to 100 cfm.

* * * * *